US005804547A

United States Patent [19]

Godfroid et al.

[11] Patent Number: 5,804,547

[45] Date of Patent: Sep. 8, 1998

[54] DRYER-ACTIVATED LAUNDRY ADDITIVE COMPOSITIONS WITH COLOR CARE AGENTS

[75] Inventors: Robert Allen Godfroid, West Chester; Ronghui Wu, Loveland; Janet Sue Littig, Fairfield; Alessandro Corona, III, Maineville; Mark Robert Sivik, Fairfield; Fred Anthony Hartman, Cincinnati; Sandra Louise Honsa, Middletown; Daniel Dale Ditullio, Jr., Fairfield, all of Ohio

[73] Assignee: The Procter & Gamble Company, Cincinnati, Ohio

[21] Appl. No.: 993,676

[22] Filed: Dec. 18, 1997

Related U.S. Application Data

[60] Provisional application No. 60/038,904 Feb. 28, 1997.

[51] Int. Cl. [6] ..... C11D 3/30; C11D 1/835

[52] U.S. Cl. ..... 510/499; 510/504; 510/520

[58] Field of Search ..... 510/504, 520, 510/521, 522, 523, 524, 499

[56] References Cited

U.S. PATENT DOCUMENTS

| | | | |
|---|---|---|---|
| 4,263,179 | 4/1981 | Schmolka | 252/548 |
| 4,390,439 | 6/1983 | Schwartz et al. | 252/73 |
| 4,536,254 | 8/1985 | Falk et al. | 162/135 |
| 4,764,289 | 8/1988 | Trinh | 252/8.6 |
| 5,114,717 | 5/1992 | Kuznitz et al. | 424/401 |
| 5,128,123 | 7/1992 | Brewster et al. | 424/65 |
| 5,186,156 | 2/1993 | Holland | 252/143 |
| 5,221,496 | 6/1993 | Holland | 252/143 |
| 5,258,174 | 11/1993 | Schebece | 424/65 |
| 5,332,714 | 7/1994 | Albrecht et al. | 504/116 |
| 5,405,605 | 4/1995 | Shin | 424/68 |
| 5,451,399 | 9/1995 | Gimbrone, Jr. et al. | 424/85.2 |

FOREIGN PATENT DOCUMENTS

| | | | |
|---|---|---|---|
| 449503 A2 | 10/1991 | European Pat. Off. . | |
| 6-299141 | 10/1994 | Japan | C09K 3/16 |

*Primary Examiner*—Paul Lieberman
*Assistant Examiner*—John R. Hardee
*Attorney, Agent, or Firm*—R. S. Echler, Sr.; K. W. Zerby; J. C. Rasser

[57] ABSTRACT

The present invention relates to dryer-activated laundry additive compositions and products having a color care agent and to methods for using the compositions and products. The dryer-activated laundry additive composition comprises from about 0.1% to about 50% of by weight of the composition of a color care agent having the formula:

$$(R_1)(R_2)N(CX_2)_nN(R_3)(R_4)$$

wherein X is selected from the group consisting of hydrogen, linear or branched; substituted or unsubstituted alkyl having from 1–10 carbons atoms and substituted or unsubstituted aryl having at least 6 carbon atoms; n is an integer from 1 to 6; $R_1$, $R_2$, $R_3$, and $R_4$ are independently selected from the group consisting of hydrogen; alkyl; aryl; alkaryl; arylalk; hydroxyalkyl; polyhydroxyalkyl; polyalkylether having the formula $—((CH_2)_yO)_zR_7$ where $R_7$ is hydrogen or a linear, branched, substituted or unsubstituted alkyl chain having from 1 to 10 carbon atoms and where y is an integer from 2 to 10 and z is an integer from 1 to 30; alkoxy; polyalkoxy having the formula: $—(O(CH_2)_y)_zR_7$; the group $—C(O)R_8$ where $R_8$ is alkyl; alkaryl; arylalk; hydroxyalkyl; polyhydroxyalkyl, polyalkylether, carboxylic acid, dicarboxylic acid, phosphonic acid and alkyl phosphonic acid as defined in $R_1$, $R_2$, $R_3$, and $R_4$; linear or branched carboxylic acid and water soluble salts thereof having the general formula $—(CH_p(R_7)_q)_t$ wherein t is an integer from 1 to 5, p+q=2; dicarboxylic acid and water soluble salts thereof; linear, branched or polyfunctional substituted branched alkyldicarboxylic acids and water soluble salts thereof; phosphonic acids and water soluble salts thereof, linear, branched or polyfinctional substituted branched alkylphosponic acids and water soluble salts thereof; and $CX_2CX_2N(R_5)(R_6)$ with no more than one of $R_1$, $R_2$, $R_3$, and $R_4$ being $CX_2CX_2N(R_5)(R_6)$ and wherein $R_5$ and $R_6$ are alkyl; alkaryl; arylalk; hydroxyalkyl; polyhydroxyalkyl, polyalkylether, alkoxy, polyalkoxy, carboxylic acid, dicarboxylic acid, phosphonic acid and alkyl phosphonic acid as defined in $R_1$, $R_2$, $R_3$, and $R_4$; and either of $R_1$+$R_3$ or $R_4$ or $R_2$+$R_3$ or $R_4$ can combine to form a cyclic substituent. Optional ingredients include a quaternary ammonium fabric softening compound, a cyclodextrin, or a perfume. Products according to the invention involved the color care composition described above disposed on a substrate such as a sheet.

9 Claims, No Drawings

DRYER-ACTIVATED LAUNDRY ADDITIVE COMPOSITIONS WITH COLOR CARE AGENTS

TECHNICAL FIELD

The present invention relates to an improvement in dryer-activated, e.g., dryer-added, laundry additive products and compositions. These products and/or compositions may be either in particulate form, compounded with other materials in, e.g., tablets, pellets, agglomerates, foams, etc., or preferably attached to a substrate.

BACKGROUND OF THE INVENTION

Due to economic considerations and convenience, consumer use of automated drying of laundered garments has increased in popularity in recent years. Not surprisingly, consumer use of dryer-activated additive compositions has also been increasing steadily. The popularity of these compositions has risen in part due to consumer desire to impart various properties to fabrics easily and quickly during the laundry process. A wide variety of ingredients have been suggested for use in laundry additive compositions to enhance the appearance and feel of fabrics. Fabric softeners provide both softening and anti-static benefits to fabrics. Perfumes deliver pleasing odors and freshness. Thus, dryer-activated additive products offer convenience, ease of use, and affordable economics to consumers as well as being superior delivery systems for desirable laundry additives such as perfumes and softeners.

In the meantime, colored items remain a large percentage of home or consumer laundered garments. These colored garments have an undesirable tendency to show appearance and color losses after multiple cycles through a laundry process. These appearance and color losses may be manifested after many multiples of cycles or only a few cycles through the laundry process. Accordingly, the usable lifetime of colored garments is reduced by the laundering process.

Accordingly, there is a need for a laundry additive composition which through the regular use of the additive composition can reduce or eliminate appearance and color losses due to the laundering process and thereby substantially increase the usable lifetime of colored garments. Also desired is a laundry additive composition which will not only reduce or eliminate color and appearance losses through regular use but which will also provide a noticeable appearance improvement to previously laundered garments which have undergone a degradation in appearance and/or color. Particularly desirable is a dryer-activated composition with the aforementioned benefits.

SUMMARY OF THE INVENTION

The present invention relates to dryer-activated additive compositions and products having a color care agent for use in an automatic clothes dryer. Methods for using the compositions and products are also provided. Improved softness, perfume delivery from sheet substrates (lower m.p. range), and/or antistatic effects may also be provided.

In accordance with a first aspect of the present invention, a dryer-activated additive composition is provided. The composition comprises from about 0. 1% to about 50% of by weight of the composition of a color care agent having the formula:

$$(R_1)(R_2)N(CX_2)_nN(R_3)(R_4)$$

wherein X is selected from the group consisting of hydrogen, linear or branched, substituted or unsubstituted alkyl having from 1–10 carbons atoms and substituted or unsubstituted aryl having at least 6 carbon atoms; n is an integer from 0 to 6; $R_1$, $R_2$, $R_3$, and $R_4$ are independently selected from the group consisting of hydrogen; alkyl; aryl; alkaryl; arylalk; hydroxyalkyl; polyhydroxyalkyl; polyalkylether having the formula $—((CH_2)_yO)_zR_7$ where $R_7$ is hydrogen or a linear, branched, substituted or unsubstituted alkyl chain having from 1 to 10 carbon atoms and where y is an integer from 2 to 10 and z is an integer from 1 to 30; alkoxy; polyalkoxy having the formula: $—(O(CH_2)_y)_zR_7$; linear or branched carboxylic acid and water soluble salts thereof having the general formula $—CR_9R_{10}R_{11}$ wherein each $R_9$, $R_{10}$, and $R_{11}$ is independently hydrogen, $—(CH_2)_xR_{12}$, and mixtures thereof; wherein $R_{12}$ is $—CO_2M$, M is hydrogen or a salt forming cation, x is from 0 to 5; phosphonic acids and water soluble salts thereof, linear, branched or polyfunctional substituted branched alkylphosponic acids and water soluble salts thereof; the group $—C(O)R_8$ where $R_8$ is alkyl; alkaryl; arylalk; hydroxyalkyl; polyhydroxyalkyl, polyalkylether, carboxylic acid containing units, dicarboxylic acid containing units, phosphonic acid and alkyl phosphonic acid as defined in $R_1$, $R_2$, $R_3$, and $R_4$; and $CX_2CX_2N(R_5)(R_6)$ with no more than one of $R_1$, $R_2$, $R_3$, and $R_4$ being $CX_2CX_2N(R_5)(R_6)$ and wherein $R_5$ and $R_6$ are alkyl; alkaryl; arylalk; hydroxyalkyl; polyhydroxyalkyl, polyalkylether, alkoxy, polyalkoxy, carboxylic acid, dicarboxylic acid, phosphonic acid and alkyl phosphonic acid as defined in $R_1$, $R_2$, $R_3$, and $R_4$; and either of $R_1+R_3$ or $R_4$ or $R_2+R_3$ or $R_4$ can combine to form a cyclic substituent.

Preferred compositions include those where $R_1$, $R_2$, $R_3$, and $R_4$ are independently selected from the group consisting of hydrogen, alkyl groups having from 1 to 5 carbon atoms and hydroxyalkyl groups having from 1 to 5 carbon atoms, preferably ethyl, methyl, hydroxyethyl, hydroxypropyl and isohydroxypropyl. The color care agent has more than about 3% nitrogen by weight of the compound and the sum of the carbon atoms in $R_1+R_2+R_3+R_4$ may be about 50 or less and preferably 20 or less. The composition may have a thermal softening point of from about 35° C. to about 100° C. Optional ingredients to the composition include a quaternary ammonium fabric softening compound, cyclodextrins, perfumes, co-softeners, $C_{10}$–$C_{26}$ acyl sorbitan monoesters or diesters, clays and mixtures thereof.

According to another embodiment of the present invention, a dryer-activated laundry additive product is provided. The product comprises a substrate in the form of a sheet and the color care composition as outlined above disposed on the sheet.

According to yet another embodiment of the present invention, a method for treating colored garments is provided. The method comprises providing at least one colored garment and the dryer-activated additive composition or product as described hereinbefore, adding the colored garment and the dryer-activated additive composition or product to a laundry dryer, heating the colored garment and the dryer-activated additive composition or product to a temperature of at least about 30° C. and agitating the colored garment and the dryer-activated additive composition for at least about one minute, more preferably at least about five minutes.

Accordingly, it is an object of the present invention to provide a laundry additive composition or product which through the regular use of the additive composition can reduce or eliminate appearance and color losses due to the laundering process and thereby substantially increase the usable lifetime of colored garments. It is also an object of the present invention to provide a laundry additive composition or product which will not only reduce or eliminate color and appearance losses through regular use but which will also provide a noticeable appearance improvement to previously laundered garments which have undergone a degradation in appearance and/or color. It is a feature of the present invention to provide a laundry additive composition or product having a color care agent or compound included in the composition or product. These and other objects, features and advantages of the present invention will be recognizable to one of ordinary skill in the art from the following description and the appended claims.

All percentages, ratios and proportions herein are on a weight basis unless otherwise indicated. All documents cited herein are hereby incorporated by reference.

DETAILED DESCRIPTION OF THE PREFERRED EMBODIMENTS

The present invention relates to dryer-activated laundry additive compositions and articles having a color care agent. The compositions and articles deliver superior color benefits including the reduction and/or elimination of color losses due to the laundering process. In addition, the composition and articles of the present invention can also, in certain circumstances, improve the appearance of colored garments which have previously undergone a degradation in appearance and/or color loss. Additional features including improved softness, delivery from the sheet, and/or antistatic effects, may also be delivered via the present invention.

Color Care Agent

The dryer-activated additive compositions and articles of the present invention include a color care agent. The compositions and articles may include from about 0.01% to about 50% by weight of the composition of the color care agent. More typically, the compositions comprise from about 0.1% to about 20%, preferably about 0.1% to about 10% and most preferably from about 0.5% to about 7% by weight of the composition of the color care agent.

The color care agent of the present invention is characterized by the formula:

$$\text{(I)}\ (R_1)(R_2)N(CX_2)_nN(R_3)(R_4).$$

In formula (I), X is selected from the group consisting of hydrogen, linear or branched, substituted or unsubstituted alkyl having from 1 to 10 carbons atoms and substituted or unsubstituted aryl having from 6 to 22 carbon atoms and n is an integer from 0 to 6. In addition, the group —$(CX_2)$— may involve a cyclic group such as cyclic $C_6H_{10}$. Preferably X is hydrogen or a linear, unsubstituted alkyl chain having from 1 to 5 carbon atoms. However, branched chain alkyl groups such as isopropyl and isobutyl may also be employed. Most preferably, n is 2 or 3 and X is hydrogen, respectively resulting in the core structure $(R_1)(R_2)N(CH_2CH_2)N(R_3)(R_4)$.

As for the groups $R_1$, $R_2$, $R_3$, and $R_4$, each is individually or independently selected from the group consisting of hydrogen; alkyl; alkaryl; arylalk; hydroxyalkyl; polyhydroxyalkyl; polyalkylether having the formula —$((CH_2)_yO)_zR_7$ where $R_7$ is hydrogen or a linear, branched, substituted or unsubstituted alkyl chain having from 1 to 10 carbon atoms and where y is an integer from 2 to 10 and z is an integer from 1 to 30; alkoxy; polyalkoxy having the formula: —$(O(CH_2)_y)_zR_7$; the group —$C(O)R_8$ where $R_8$ is alkyl; alkaryl; arylalk; hydroxyalkyl; polyalkylether, polyhydroxyalkyl, carboxylic acid, dicarboxylic acid, phosphonic acid and alkyl phosphonic acid as defined in $R_1$, $R_2$, $R_3$, and $R_4$; linear or branched carboxylic acid and water soluble salts thereof having the general formula —$CR_9R_{10}R_{11}$ wherein each $R_9$, $R_{10}$, and $R_{11}$ is independently hydrogen, —$(CH_2)_xR_{12}$, and mixtures thereof; wherein $R_{12}$ is —$CO_2M$, M is hydrogen or a salt forming cation, x is from 0 to 5; phosphonic acids and water soluble salts thereof; linear, branched or polyfunctional substituted branched alkylphosphonic acids and water soluble salts thereof and $CX_2CX_2N(R_5)(R_6)$.

The available alkyl groups include linear or branched, substituted or unsubstituted alkyl groups typically having from about 1 to about 22 carbon atoms, preferably 1–10 carbon atoms. Most preferred alkyl groups include methyl, ethyl, propyl, and isopropyl. The available aryl groups include substituted or unsubstituted aryl groups typically having from about 6 to about 22 carbon atoms. Substitutions may include alkyl chains as earlier described thereby providing alkaryl or arylalk groups having from about 6 to about 22 carbon atoms. Preferred aryl, arylalk and alkaryl groups include phenyl, benzyl and mesityl. The available hydroxyalkyl and polyhydroxyalkyl groups include linear or branched, substituted or unsubstituted groups typically having from about 1 to about 22 carbon atoms. Preferred groups include hydroxymethyl, hydroxyethyl, 1-hydroxypropyl and 2-hydroxypropyl. The available polyalkoxy groups include those having the formula: —$(O(CH_2)_y)_zR_7$. The integer y typically ranges from 2 to about 10 with 1, 2, and 3 the most preferred. The group —$(CH_2)_y$— may include both linear and branched chains. Preferred groups include methoxyl, ethoxyl and isopropoxyl. The integer z typically ranges from about 1 to 30 with lower levels of ethoxylation being preferred. $R_7$ is typically hydrogen or an alkyl groups having 1 to 5 carbon atoms. Polyalkylether having the formula —$((CH_2)_yO)_zR_7$ may also be employed in the present invention where the integer y typically ranges from 2 to about 10 with 1, 2, and 3 the most preferred, the group —$(CH_2)_y$— may include both linear and branched chains, preferred groups including methoxyl, ethoxyl and isopropoxyl, z typically ranges from about 1 to 30 with lower levels of ethoxylation being preferred and $R_7$ is typically hydrogen or an alkyl groups having 1 to 5 carbon atoms. The group —$C(O)R_8$ may also be employed where $R_8$ is alkyl; alkaryl; arylalk; hydroxyalkyl; polyhydroxyalkyl, polyalkylether, carboxylic acid, dicarboxylic acid, phosphonic acid and alkyl phosphonic acid as defined above.

Remaining $R_1$, $R_2$, $R_3$, and $R_4$ possibilities include linear or branched carboxylic acid and water soluble salts thereof having the general formula —$CR_9R_{10}R_{11}$ wherein each $R_9$, $R_{10}$, and $R_{11}$ is independently hydrogen, —$(CH_2)_xR_{12}$, and mixtures thereof; wherein $R_{12}$ is —$CO_2M$, M is hydrogen or a salt forming cation, x is from 0 to 5. As x typically ranges from about 1 to about 5, the total number of carbons typically does not exceed 6 and M is a water soluble cation such as alkali metal or other available groups such as ammonium or substituted ammonium. Also available are dicarboxylic acid groups, when two or more $R_9$, $R_{10}$, or $R_{11}$ are equal to —$(CH_2)_xR_{12}$, including the water soluble salts, which have from about 2 to about 5 carbons atoms, and linear, branched or polyfunctional substituted branched alkyldicarboxylic acids and water soluble salts thereof also having from about 2 to about 5 carbon atoms. Preferred carboxylates include ethylenediaminetetraacetates acid (EDTA), N-hydroxyethylethylenediamine-triacetates acid, nitrilotriacetates (NTA), ethylenediamine tetraproprionates, ethylenediamine-N,N'-diglutamates, 2-hyroxypropylenediamine-N,N'-disuccinates, triethylenetetraaminehexacetates, diethylenetriaminepentaacetates (DETPA) such as diethylenetriaminepentacetic acid (DTPA), and ethanoldiglycines, including their water-soluble salts such as the alkali metal, ammonium, and substituted ammonium salts thereof and mixtures thereof Phosphonic acids and water soluble salts thereof and linear, branched or polyfinctional substituted branched alkylphosphonic acids and water soluble salts thereof may be employed as $R_1$, $R_2$, $R_3$, and $R_4$. In both cases, the number of carbon atoms typically ranges from about 1 to about 5. Preferred groups include ethylenediaminetetrakis (methylenephosphonates), diethylenetriamine-N,N,N',N", N"-pentakis(methane phosphonate) (DETMP) and 1-hydroxyethane-1,1-diphosphonate (HEDP).

$R_1$, $R_2$, $R_3$, and $R_4$ may also be the group $CX_2CX_2N(R_5)(R_6)$. However, when the group is present, no more than one of $R_1$, $R_2$, $R_3$, and $R_4$ at any one time may be the group $CX_2CX_2N(R_5)(R_6)$. Furthermore, $R_5$ and $R_6$ are alkyl; alkaryl; arylalk; hydroxyalkyl; polyhydroxyalkyl, polyalkylether, alkoxy, polyalkoxy carboxylic acid, dicarboxylic acid, phosphonic acid and alkyl phosphonic acid as defined above for $R_1$, $R_2$, $R_3$, and $R_4$. Preferably, when any one of $R_1$, $R_2$, $R_3$, and $R_4$ is present as the group $CX_2CX_2N(R_5)(R_6)$, then $R_5$ and $R_6$ are preferably, alkyl or hydroxyalkyl groups as defined above. Lastly, either of $R_1+R_3$ or $R_4$ or $R_2+R_3$ or $R_4$ can combine to form a cyclic substituent. Suitable examples include the moiety:

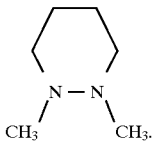

To provide suitable color care properties, the preferred color care agent materials according to the present invention consist of not less than 3% by weight of the compound of nitrogen, more preferably not less than 7% and most preferably not less than 9% by weight of the compound. The preferred color care agents according to the present inventiona total number of carbon atoms in the groups $R_1+R_2+R_3+R_4$ of about 50 or less, more preferably of about 40 or less and most preferably of about 20 or less.

Most preferably, $R_1$, $R_2$, $R_3$, and $R_4$ are independently selected from the group consisting of hydrogen, linear alkyl groups having from 1 to 5 carbon atoms and linear hydroxyalkyl groups having from 1 to 5 carbon atoms. Especially preferred are the groups ethyl, methyl, hydroxyethyl and hydroxypropyl. While each of $R_1$, $R_2$, $R_3$, and $R_4$ may be individually selected, the preferred color care component according to the present invention involves the situation wherein each of $R_1$, $R_2$, $R_3$, and $R_4$ are hydroxyalkyl groups having from 1 to 5 carbon atoms. A preferred list of compounds includes N,N,N',N' tetraethylethylenediamine, 2-{[2-(dimethylamino)ethyl]-methylamino}ethanol, Bis-(2-hydroxyethyl)-N,N'-dimethylethylenediamine, Bis(octyl)-N,N'-dimethylethylenediamine, N,N,N',N'-tetrakis(2-hydroxypropyl) ethylenediamine, N,N,N',N",N", penta(2-hydroxypropyl)diethylenetriamine, N,N'-diethylethyldiamine, N,N,N'-trimethylethylenediamine, 1,3-pentadiamine, N,N-dimethylethylenediamine, 2-(2-aminoethylamino)ethanol, N,N'-dimethylethylenediamine, 1,3-diamino-2-hydroxypropane, N'-methyl-2,2'-diaminodiethylamine, N-(2-aminoethyl)- 1,3-propanediamine. Particulalry preferred is N,N,N',N'-tetrakis (2-hydroxypropyl) ethylenediamine and N,N,N',N",N", penta(2-hydroxypropyl)diethlyenetriamine. Such materials are commercially available from a number of sources including BASF of Washington, N.J. under the tradename QUADROL and PENTROL.

Ajunct Ingredients

Well known optional adjunct components included in dryer-activated laundry compositions are narrated in U.S. Pat. No. 4,103,047, Zaki et al., issued Jul. 25, 1978, for "Fabric Treatment Compositions," the disclosure of which is herein incorporated by reference.

(1) Fabric Softening Component

Compositions of the present invention may also contain from about 1% to about 60%, preferably from about 10% to about 50%, more preferably from about 15% to about 40% of fabric softening component. The fabric softening component is preferably ester quaternary ammonium compounds (EQA).

Preferably, the EQA of the present invention is selected from Formulas II, III, IV, V, and mixtures thereof.

Formula II comprises:

$$[(R^1)_{4-p}—N^-—((CH_2)_v—Y—R^2)_p]X^-$$

wherein each Y=—O—(O)C—, or —C(O)—O—;

p=1 to 3;

each v=is an integer from 1 to 4, and mixtures thereof;

each $R^1$ substituent is a short chain $C_1$–$C_6$, preferably $C_1$–$C_3$, alkyl group, e.g., methyl (most preferred), ethyl, propyl, and the like, benzyl and mixtures thereof;

each $R^2$ is a long chain, saturated and/or unsaturated (Iodine Value of from about 3 to about 60), $C_8$–$C_{30}$ hydrocarbyl, or substituted hydrocarbyl substituent and mixtures thereof; and the counterion, X , can be any softener-compatible anion, for example, methylsulfate, ethylsulfate, chloride, bromide, formate, sulfate, lactate, nitrate, benzoate, and the like, preferably methylsulfate.

It will be understood that substituents $R^1$ and $R^2$ of Formula II can optionally be substituted with various groups such as alkoxyl or hydroxyl groups. The preferred compounds can be considered to be diester quaternary ammonium salts (DEQA). At least 25% of the DEQA is in the diester form, and from 0% to about 40%, preferably less than about 30%, more preferably less than about 20%, can be EQA monoester (e.g., only one —Y—$R^2$ group).

As used herein, when the diester is specified, it will include the monoester that is normally present. For the optimal antistatic benefit the percentage of monoester should be as low as possible, preferably less than about 2.5%. The level of mono-ester present can be controlled in the manufacturing of the EQA.

EQA compounds prepared with fully saturated acyl groups are excellent softeners. However, it has now been discovered that compounds prepared with at least partially unsaturated acyl groups have advantages (i.e., antistatic benefits) and are highly acceptable for consumer products when certain conditions are met.

Variables that must be adjusted to obtain the benefits of using unsaturated acyl groups include the Iodine Value of the fatty acids, the odor of fatty acid starting material, and/or the EQA. Any reference to Iodine Value values hereinafter refers to Iodine Value of fatty acyl groups and not to the resulting EQA compound.

Some highly desirable, readily available sources of fatty acids such as tallow, possess odors that remain with the compound EQA despite the chemical and mechanical processing steps which convert the raw tallow to finished EQA. Such sources must be deodorized, e.g., by absorption, distillation (including stripping such as steam stripping), etc., as is well known in the art. In addition, care must be taken to minimize contact of the resulting fatty acyl groups to oxygen and/or bacteria by adding antioxidants, antibacterial agents, etc.

Generally, hydrogenation of fatty acids to reduce polyunsaturation and to lower Iodine Value to insure good color and odor stability leads to a high degree of trans configuration in the molecule. Therefore, diester compounds derived from fatty acyl groups having low Iodine Value values can be made by mixing fully hydrogenated fatty acid with touch hydrogenated fatty acid at a ratio which provides an Iodine Value of from about 3 to about 60. The polyunsaturation content of the touch hardened fatty acid should be less than about 5%, preferably less than about 1%. During touch hardening the cis/trans isomer weight ratios are controlled by methods known in the art such as by optimal mixing, using specific catalysts, providing high $H_2$ availability, etc.

It has been found that a solvent may be used to facilitate processing of the Formula II EQA and/or of the fabric softening composition containing the Formula II EQA.

It has also been found that for good chemical stability of the diester quaternary compound in molten storage, water levels in the raw material must be minimized to preferably less than about 8% and more preferably less than about 5%. Storage temperatures should be kept as low as possible and still maintain a fluid material, ideally in the range of from about 45° C. to about 70° C. The optimum storage temperature for stability and fluidity depends on the specific Iodine Value of the fatty acid used to make the diester quaternary and the level/type of solvent selected. Also, exposure to oxygen should be minimized to keep the unsaturated groups from oxidizing. It can therefore be important to store the material under a reduced oxygen atmosphere such as a nitrogen blanket. It is important to provide good molten storage stability to provide a commercially feasible raw material that will not degrade noticeably in the normal transportation/storage/handling of the material in manufacturing operations.

The following are non-limiting examples of EQA Formula II (wherein all long-chain alkyl substituents are straight-chain):

Saturated $(C_2H_5)_2{}^+N(CH_2CH_2OC(O)C_{17}H_{35})_2\,(CH_3SO_4)^-$
$(HO{-}CH(CH_3)CH_2)(CH_3)^+N(CH_2CH_2OC(O)C_{15}H_{31})_2Br^-$
$(CH_3)(C_2H_5)^+N(CH_2CH_2OC(O)C_{13}H_{27})_2(HCOO)^-$
$(C_3H_7)(C_2H_5)^+N(CH_2CH_2OC(O)C_{11}H_{23})_2(CH_3SO_4)^-$
$(CH_3)_2{}^+N{-}CH_2CH_2OC(O)C_{15}H_{31}(CH_3SO_4)^-$
$\quad\quad |$
$\quad\quad CH_2CH_2OC(O)C_{17}H_{35}$
$(CH_3)_2{}^+N(CH_2CH_2OC(O)R^2)_2(CH_3SO_4)^-$
$(CH_2CH_2OH)(CH_3)^+N(CH_2CH_2OC(O)R^2)_2(CH_3SO_4)^-$ where $-C(O)R^2$ is derived from saturated tallow.

Unsaturated $(C_2H_5)_2{}^+N(CH_2CH_2OC(O)C_{17}H_{33})_2(CH_3SO_4)^-$
$(HO{-}CH(CH_3)CH_2)(CH_3)^+N(CH_2CH_2OC(O)C_{15}H_{29})_2\,Br^-$
$(C_2H_5)_2{}^+N(CH_2CH_2OC(O)C_{17}H_{33})_2Cl^-$
$(CH_3)(C_2H_5)^+N(CH_2CH_2OC(O)C_{13}H_{27})_2(C_6H_5COO)^-$
$(CH_3)_2{}^+N{-}CH_2CH_2OC(O)C_{15}H_{29}(CH_3CH_2SO_4)^-$
$\quad\quad |$
$\quad\quad CH_2CH_2OC(O)C_{17}H_{33}$
$(CH_2CH_2OH)(CH_3)^+N(CH_2CH_2OC(O)R^2)_2(CH_3SO_4)^-$
$(CH_3)_2{}^+N(CH_2CH_2OC(O)R^2)_2(CH_3SO_4)^-$
$(HOCH_2CH_2)(CH_3)N^+(CH_2CH_2OC(O)R^2)_2(CH_3SO_4)^-$ where $-C(O)R^2$ is derived from partially hydrogenated tallow or modified tallow having the characteristics set forth herein.

In addition to Formula II compounds, the compositions and articles of the present invention comprise EQA compounds of Formula III:

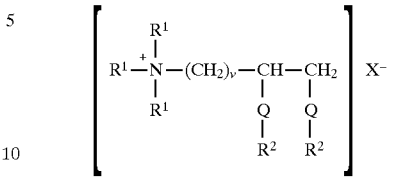

wherein, for any molecule:

each Q is —O—C(O)— or —C(O)—O—;

each $R^1$ is $C_1$–$C_4$ alkyl or hydroxy alkyl;

$R^2$ and v are defined hereinbefore for Formula II; and wherein preferably $R^1$ is a methyl group, v is 1, Q is —O—C(O)—, each $R^2$ is $C_{14}$–$C_{18}$, and $X^-$ is methyl sulfate.

The straight or branched alkyl or alkenyl chains, $R^2$, have from about 8 to about 30 carbon atoms, preferably from about 14 to about 18 carbon atoms, more preferably straight chains having from about 14 to about 18 carbon atoms.

Tallow is a convenient and inexpensive source of long chain alkyl and alkenyl materials.

A specific example of a Formula III EQA compound suitable for use in the fabric softening compositions herein is: 1,2-bis(tallowyl oxy)-3-trimethyl ammoniopropane methylsulfate (DTTMAPMS).

Other examples of suitable Formula III EQA compounds of this invention are obtained by, e.g., replacing "tallowyl" in the above compounds with, for example, cocoyl, lauryl, oleyl, stearyl, palmityl, or the like;

replacing "methyl" in the above compounds with ethyl, propyl, isopropyl, butyl, isobutyl, t-butyl, or the hydroxy substituted analogs of these radicals;

replacing "methylsulfate" in the above compounds with chloride, ethylsulfate, bromide, formate, sulfate, lactate, nitrate, and the like, but methylsulfate is preferred.

In addition to Formula II and Formula III compounds, the compositions and articles of the present invention comprise EQA compounds of Formula IV:

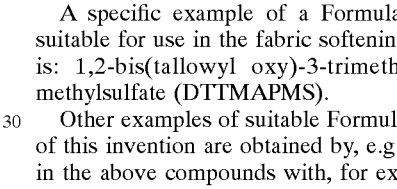

wherein $R^4$=a short chain $C_1$–$C_4$ alcohol;

p is 2;

$R^1$,$R^2$, v, Y, and $X^-$ are as previously defined for Formula II.

A specific example of a Formula IV compound suitable for use in the fabric softening compositions herein is N-methyl-N,N-di-(2-($C_{14}$–$C_{18}$-acyloxy) ethyl), N-2-hydroxyethyl ammonium methylsulfate. A preferred compound is N-methyl, N,N-di-(2-oleyloxyethyl) N-2-hydroxyethyl ammonium methylsulfate.

Compositions of the present invention may also comprise Formula V compounds:

$$[(R^1)_{4-p}{-}N^+{-}((CH_2)_v{-}Y''{-}R^2)_p]X^-$$

$R^1$, $R^2$, p, v, and $X^-$ are previously defined in Formula II; and $$[(R^1)_{4-p}{-}N^+{-}((CH_2)_v{-}Y{-}R^2)_p]X^-$$

and mixtures thereof, wherein at least one Y" group is

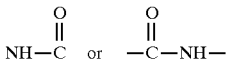

An example of this compound is methyl bis (oleyl amidoethyl) 2-hydroxyethyl ammonium methyl sulfate.

Preferably, the fabric softening component of the present invention is a quaternary ammonium compound.

The compounds herein can be prepared by standard esterification and quaternization reactions, using readily available starting materials. General methods for preparation are disclosed in U.S. Pat. No. 4,137,180, incorporated herein by reference.

(2) Co-Softener

Color care compositions employed herein may contain as an optional component, at a level of from about 1% to about 60%, preferably from about 5% to about 50%, more preferably from about 10% to about 40%, by weight of the composition of a carboxylic acid salt of a tertiary amine and/or ester amine which has the formula:

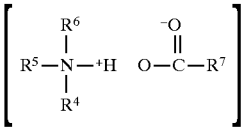

wherein $R^5$ is a long chain aliphatic group containing from about 8 to about 30 carbon atoms; $R^6$ and $R^4$ are the same or different from each other and are selected from the group consisting of aliphatic groups containing containing from about 1 to about 30 carbon atoms, hydroxyalkyl groups of the Formula $R^8$ OH wherein $R^8$ is an alkylene group of from about 2 to about 30 carbon atoms, and alkyl ether groups of the formula $R^9O(C_nH_{2n}O)_m$ wherein $R^9$ is alkyl and alkenyl of from about 1 to about 30 carbon atoms and hydrogen, n is 2 or 3, and m is from about 1 to about 30; wherein $R^4$, $R^5$, $R^6$, $R^8$, and $R^9$ chains can be ester interrupted groups; and wherein $R^7$ is selected from the group consisting of unsubstituted alkyl, alkenyl, aryl, alkaryl and aralkyl of about 8 to about 30 carbon atoms, and substituted alkyl, alkenyl, aryl, alkaryl, and aralkyl of from about 1 to about 30 carbon atoms wherein the substituents are selected from the group consisting of halogen, carboxyl, and hydroxyl, said composition having a thermal softening point of from about 35° C. to about 100° C.

This component provides the following benefits: superior odor, and/or improved fabric softening performance, compared to similar articles which utilize primary amine or ammonium compounds as the sole fabric conditioning agent. Either $R^4$, $R^5$, $R^6$, $R^7$, $R^8$, and/or $R_9$ chains can contain unsaturation.

Preferably, $R^5$ is an aliphatic chain containing from about 12 to about 30 carbon atoms, $R^6$ is an aliphatic chain of from about 1 to about 30 carbon atoms, and $R^4$ is an aliphatic chain of from about 1 to about 30 carbon atoms. Particularly preferred tertiary amines for static control performance are those containing unsaturation; e.g., oleyldimethylamine and/or soft tallowdimethylamine.

Examples of preferred tertiary amines as starting material for the reaction between the amine and carboxylic acid to form the tertiary amine salts are: lauryldimethylamine, myristyldimethylamine, stearyldimethylamine, tallowdimethylamine, coconutdimethylamine, dilaurylmethylamine, distearylmethylamine, ditallowmethylamine, oleyldimethylamine, dioleylmethylamine, lauryldi(3-hydroxypropyl)amine, stearyldi(2-hydroxyethyl)amine, trilaurylamine, laurylethylmethylamine, and

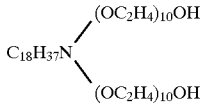

Preferred fatty acids are those wherein $R^7$ is a long chain, unsubstituted alkyl or alkenyl group of from about 8 to about 30 carbon atoms, more preferably from about 11 to about 17 carbon atoms.

Examples of specific carboxylic acids as a starting material are: formic acid, acetic acid, lauric acid, myristic acid, palmitic acid, stearic acid, oleic acid, oxalic acid, adipic acid, 12-hydroxy stearic acid, benzoic acid, 4-hydroxy benzoic acid, 3-chloro benzoic acid, 4-nitro benzoic acid, 4-ethyl benzoic acid, 4-(2-chloroethyl)-benzoic acid, phenylacetic acid, (4-chlorophenyl)acetic acid, (4-hydroxyphenyl)acetic acid, and phthalic acid.

Preferred carboxylic acids are stearic, oleic, lauric, myristic, palmitic, and mixtures thereof.

The amine salt can be formed by a simple addition reaction, well known in the art, disclosed in U.S. Pat. No. 4,237,155, Kardouche, issued Dec. 2, 1980, which is incorporated herein by reference. Excessive levels of free amines may result in odor problems, and generally free amines provide poorer softening performance than the amine salts.

Preferred amine salts for use herein are those wherein the amine moiety is a $C_8$–$C_{30}$ alkyl or alkenyl dimethyl amine or a di-$C_8$–$C_{30}$ alkyl or alkenyl methyl amine, and the acid moiety is a $C_8$–$C_{30}$ alkyl or alkenyl monocarboxylic acid. The amine and the acid, respectively, used to form the amine salt will often be of mixed chain lengths rather than single chain lengths, since these materials are normally derived from natural fats and oils, or synthetic processed which produce a mixture of chain lengths. Also, it is often desirable to utilize mixtures of different chain lengths in order to modify the physical or performance characteristics of the softening composition.

Specific preferred amine salts for use in the present invention are oleyldimethylamine stearate, stearyldimethylamine stearate, stearyldimethylamine myristate, stearyldimethylamine oleate, stearyldimethylamine palmitate, distearylmethylamine palmitate, distearylmethylamine laurate, and mixtures thereof. A particularly preferred mixture is oleyldimethylamine stearate and distearylmethylamine myristate, in a ratio of 1:10 to 10: 1, preferably about 1:1.

(3) Nonionic Softener

An optional softening agent which may also be employed in the present invention is a nonionic fabric softener material. Typically, such nonionic fabric softener materials have an HLB of from about 2 to about 9, more typically from about 3 to about 7. In general, the materials selected should be relatively crystalline and higher melting, (e.g., >25° C.).

The level of optional nonionic softener in the solid composition is typically from about 0.1% to about 50%, preferably from about 5% to about 30%.

Preferred nonionic softeners are fatty acid partial esters of polyhydric alcohols, or anhydrides thereof, wherein the alcohol, or anhydride, contains from about 2 to about 18, preferably from about 2 to about 8, carbon atoms, and each fatty acid moiety contains from about 8 to about 30, preferably from about 12 to about 20, carbon atoms. Typically, such softeners contain from about one to about 3, preferably about 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan.

The fatty acid portion of the ester is normally derived from fatty acids having from about 8 to about 30, preferably from about 12 to about 22, carbon atoms. Typical examples of said fatty acids being lauric acid, myristic acid, palmitic acid, stearic acid, oleic acid, and behenic acid.

Highly preferred optional nonionic softening agents for use in the present invention are $C_{10}$–$C_{26}$ acyl sorbitan esters and polyglycerol monostearate. Sorbitan esters are esterified dehydration products of sorbitol. The preferred sorbitan ester comprises a member selected from the group consisting of $C_{10}$–$C_{26}$ acyl sorbitan monoesters and $C_{10}$–$C_{26}$ acyl sorbitan diesters and ethoxylates of said esters wherein one or more of the unesterified hydroxyl groups in said esters contain from 1 to about 6 oxyethylene units, and mixtures thereof For the purpose of the present invention, sorbitan esters containing unsaturation (e.g., sorbitan monooleate) can be utilized.

Sorbitol, which is typically prepared by the catalytic hydrogenation of glucose, can be dehydrated in well known fashion to form mixtures of 1,4- and 1,5-sorbitol anhydrides and small amounts of isosorbides. (See U.S. Pat. No. 2,322, 821, Brown, issued Jun. 29, 1943, incorporated herein by reference.)

The foregoing types of complex mixtures of anhydrides of sorbitol are collectively referred to herein as "sorbitan." It will be recognized that this "sorbitan" mixture will also contain some free, uncyclized sorbitol.

The preferred sorbitan softening agents of the type employed herein can be prepared by esterifying the "sorbitan" mixture with a fatty acyl group in standard fashion, e.g., by reaction with a fatty acid halide, fatty acid ester, and/or fatty acid. The esterification reaction can occur at any of the available hydroxyl groups, and various mono-, di-, etc., esters can be prepared. In fact, mixtures of mono-, di-, tri-, etc., esters almost always result from such reactions, and the stoichiometric ratios of the reactants can be simply adjusted to favor the desired reaction product.

For commercial production of the sorbitan ester materials, etherification and esterification are generally accomplished in the same processing step by reacting sorbitol directly with fatty acids. Such a method of sorbitan ester preparation is described more fully in MacDonald; "Emulsifiers:" Processing and Quality Control:, *Journal of the American Oil Chemists' Society,* Vol. 45, October 1968.

Details, including formula, of the preferred sorbitan esters can be found in U.S. Pat. No. 4,128,484, incorporated hereinbefore by reference.

Certain derivatives of the preferred sorbitan esters herein, especially the "lower" ethoxylates thereof (i.e., mono-, di-, and tri-esters wherein one or more of the unesterified —OH groups contain one to about twenty oxyethylene moieties (Tweens®) are also useful in the composition of the present invention. Therefore, for purposes of the present invention, the term "sorbitan ester" includes such derivatives.

For the purposes of the present invention, it is preferred that a significant amount of di- and tri- sorbitan esters are present in the ester mixture. Ester mixtures having from 20–50% mono-ester, 25–50% di-ester and 10–35% of tri- and tetra-esters are preferred.

The material which is sold commercially as sorbitan mono-ester (e.g., monostearate) does in fact contain significant amounts of di- and tri-esters and a typical analysis of sorbitan monostearate indicates that it comprises about 27% mono-, 32% di- and 30% tri- and tetra-esters. Commercial sorbitan monostearate therefore is a preferred material. Mixtures of sorbitan stearate and sorbitan palmitate having stearate/palmitate weight ratios varying between 10:1 and 1:10, and 1,5-sorbitan esters are useful. Both the 1,4- and 1,5-sorbitan esters are useful herein.

Other useful alkyl sorbitan esters for use in the softening compositions herein include sorbitan monolaurate, sorbitan monomyristate, sorbitan monopalmitate, sorbitan monobehenate, sorbitan monooleate, sorbitan dilaurate, sorbitan dimyristate, sorbitan dipalmitate, sorbitan distearate, sorbitan dibehenate, sorbitan dioleate, and mixtures thereof, and mixed tallowalkyl sorbitan mono- and di-esters. Such mixtures are readily prepared by reacting the foregoing hydroxy-substituted sorbitans, particularly the 1,4- and 1,5-sorbitans, with the corresponding acid, ester, or acid chloride in a simple esterification reaction. It is to be recognized, of course, that commercial materials prepared in this manner will comprise mixtures usually containing minor proportions of uncyclized sorbitol, fatty acids, polymers, isosorbide structures, and the like. In the present invention, it is preferred that such impurities are present at as low a level as possible.

The preferred sorbitan esters employed herein can contain up to about 15% by weight of esters of the $C_{20}$–$C_{26}$, and higher, fatty acids, as well as minor amounts of $C_8$, and lower, fatty esters.

Glycerol and polyglycerol esters, especially glycerol, diglycerol, triglycerol, and polyglycerol mono- and/or di-esters, preferably mono-, are also preferred herein (e.g., polyglycerol monostearate with a trade name of Radiasurf 7248). Glycerol esters can be prepared from naturally occurring triglycerides by normal extraction, purification and/or interesterification processes or by esterification processes of the type set forth hereinbefore for sorbitan esters. Partial esters of glycerin can also be ethoxylated to form usable derivatives that are included within the term "glycerol esters."

Useful glycerol and polyglycerol esters include mono-esters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol, e.g., diglycerol through octaglycerol esters. The polyglycerol polyols are formed by condensing glycerin or epichlorohydrin together to link the glycerol moieties via ether linkages. The mono- and/or diesters of the polyglycerol polyols are preferred, the fatty acyl groups typically being those described hereinbefore for the sorbitan and glycerol esters.

(4) Cyclodextrin/Perfume Complexes and Free Perfume

The compositions and products herein may also contain from about 0.5% to about 60%, preferably from about 1% to about 50%, more preferably 2% to about 25%, cyclodextrin/perfume inclusion complexes and/or free perfume, as disclosed in U.S. Pat. Nos. 5,139,687, Borcher et al., issued Aug. 18, 1992; and 5,234,610, Gardlik et al., issued Aug. 10, 1993, the disclosures of which are herein incorporated by reference. Perfumes are highly desirable, can usually benefit from protection, and can be complexed with cyclodextrin. Dryer-added products typically contain perfume to provide an olfactory aesthetic benefit and/or to serve as a signal that the product is effective.

The optional perfume ingredients and compositions of this invention are the conventional ones known in the art. Selection of any perfume component, or amount of perfume, is based solely on aesthetic considerations. Suitable perfume compounds and compositions can be found in the art including U.S. Pat. Nos.: 4,145,184, Brain and Cummins, issued Mar. 20, 1979; 4,209,417, Whyte, issued Jun. 24, 1980; 4,515,705, Moeddel, issued May 7, 1985; and 4,152,272, Young, issued May 1, 1979, all of said patents being incorporated herein by reference. Many of the art recognized perfume compositions are relatively substantive to maximize their odor effect on substrates. However, it is a special advantage of perfume delivery via the perfume/cyclodextrin complexes that nonsubstantive perfumes are also effective. If a product contains both free and complexed perfume, the escaped perfume from the complex contributes to the overall perfume odor intensity, giving rise to a longer lasting perfume odor impression.

As disclosed in U.S. Pat. No. 5,234,610, Gardlik/Trinh/Banks/Benvegnu, issued Aug. 3, 1993, said patent being incorporated herein by reference, by adjusting the levels of free perfume and perfume/CD complex it is possible to provide a wide range of unique perfume profiles in terms of timing (release) and/or perfume identity (character). Solid, dryer-activated compositions are a uniquely desirable way to apply the cyclodextrins, since they are applied at the very end of a fabric treatment regimen when the fabric is clean and when there are almost no additional treatments that can remove the cyclodextrin before the next wash cycle.

(5) Soil Release Polymer

Optionally, the compositions herein contain from 0.01% to about 10%, preferably from about 0.1% to about 5%, more preferably from about 0.1% to about 2%, of a soil release agent. Preferably, such a soil release agent is a polymer. Polymeric soil release agents useful in the present invention include copolymeric blocks of terephthalate and polyethylene oxide or polypropylene oxide, and the like. U.S. Pat. No. 4,956,447, Gosselink/Hardy/Trinh, issued Sep. 11, 1990, discloses specific preferred soil release agents comprising cationic finctionalities, said patent being incorporated herein by reference.

A preferred soil release agent is a copolymer having blocks of terephthalate and polyethylene oxide. More specifically, these polymers are comprised of repeating units of ethylene and/or propylene terephthalate and polyethylene oxide terephthalate at a molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

U.S. Pat. No. 4,976,879, Maldonado/Trinh/Gosselink, issued Dec. 11, 1990, discloses specific preferred soil release agents which can also provide improved antistat benefit, said patent being incorporated herein by reference.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6: 1. Examples of this polymer include the commercially available materials Zelcon® 4780 (from DuPont) and Milease® T (from ICI).

A more complete disclosure of these highly preferred soil release agents is contained in European Pat. Application 185,427, Gosselink, published Jun. 25, 1986, incorporated herein by reference.

(6) Other Optional Ingredients

The present invention can include other optional components (minor components) conventionally used in textile treatment compositions, for example, anti-oxidants, colorants, preservatives, optical brighteners, opacifiers, stabilizers such as guar gum and polyethylene glycol, anti-shrinkage agents, anti-wrinkle agents, soil release agents, fabric crisping agents, reductive agents, spotting agents, germicides, fungicides, anti-corrosion agents, antifoam agents, and the like.

D. Substrate Articles

In preferred embodiments, the present invention encompasses articles of manufacture or products. Representative articles are those that are adapted to be employed in an automatic laundry dryer, of the types disclosed in U.S. Pat. Nos.:

3,989,631 Marsan, issued Nov. 2, 1976; 4,055,248, Marsan, issued Oct. 25, 1977; 4,073,996, Bedenk et al., issued Feb. 14, 1978; 4,022,938, Zaki et al., issued May 10, 1977; 4,764,289, Trinh, issued Aug. 16, 1988; 4,808,086, Evans et al., issued Feb. 28,1989; 4,103,047, Zaki et al., issued Jul. 25, 1978; 3,736,668, Dillarstone, issued Jun. 5, 1973; 3,701,202, Compa et al., issued Oct. 31,1972; 3,634,947, Furgal, issued Jan. 18, 1972; 3,633,538, Hoeflin, issued Jan. 11, 1972; and 3,435,537, Rumsey, issued Apr. 1, 1969; and 4,000,340, Murphy et al., issued Dec. 28, 1976, all of said patents being incorporated herein by reference.

In a preferred substrate article embodiment, the color care compositions are provided as an article of manufacture in combination with a dispensing means such as a flexible substrate which effectively releases the composition in an automatic laundry (clothes) dryer. Such dispensing means can be designed for single usage or for multiple uses. The dispensing means can also be a "carrier material" that releases the color care composition and then is dispersed and/or exhausted from the dryer.

The dispensing means will normally carry an effective amount of color care composition. Such effective amount typically provides sufficient color care benefit for at least one treatment of a minimum load in an automatic laundry dryer. Amounts of the color care composition irrespective of load size for a single article can vary from about 0.1 g to about 100 g, preferably from about 0.05 g to about 20 g, most preferably from about 0.1 g to about 10 g.

Highly preferred paper, woven or nonwoven "absorbent" substrates useful herein are fully disclosed in U.S. Pat. No. 3,686,025, Morton, issued Aug. 22, 1972, incorporated herein by reference. It is known that most substances are able to absorb a liquid substance to some degree; however, the term "absorbent" as used herein, is intended to mean a substance with an absorbent capacity (i.e., a parameter representing a substrate's ability to take up and retain a liquid) from 4 to 12, preferably 5 to 7, times its weight of water.

Another article comprises a sponge material releasably enclosing enough color care composition to effectively impart color care benefits during several cycles of clothes. This multi-use article can be made by filling a hollow sponge with about 20 grams of the color care composition. Other delivery means include synthetic foams, towels-like substrates, particles (tablets, pellets, granules, etc) and dispensers affixed to the dryer wall.

E. Usage

The substrate embodiment of this invention can be used for imparting the above-described composition to fabric to provide color care as well as softening and/or antistatic effects to fabric in an automatic laundry dryer. Generally, the method of using the composition of the present invention comprises: commingling pieces of damp or dry fabric by tumbling the fabric under heat in an automatic clothes dryer with an effective amount of the composition. At least the continuous phase of the composition has a viscosity of less than 2000 cps at 100° F. (38° C.) and a melting point greater than about 25° C. and preferably from about 35° C. to about 100° C. and the composition is flowable at dryer operating temperature. This composition comprises from about 3% to about 90%, preferably from about 5% to about 90%, of the quaternary ammonium agent selected from the above-defined cationic fabric softeners and mixtures thereof, from about 0.1% to about 95%, preferably from about 3% to about 75%, more preferably from about 5% to about 60% of the above-defined co-softener.

The present invention relates to improved dryer-activated fabric softener compositions which are either (A) incorporated into articles of manufacture in which the compositions are, e.g., on a substrate, or are (B) in the form of particles (including, where appropriate, agglomerates, pellets, and tablets of said particles). Such compositions contain from about 30% to about 95% of normally solid, dryer-softenable material, typically fabric softening agent, containing an effective amount of unsaturation.

In the specification and examples herein, all percentages, ratios and parts are by weight unless otherwise specified and all numerical limits are normal approximations.

The following examples illustrate the esters and compositions of this invention, but are not intended to be limiting thereof.

EXAMPLE I

Dryer-activated color care compositions according to the present invention include the following:

| Component | A Wt. % | B Wt. % | C Wt. % | D Wt. % | E Wt. % |
|---|---|---|---|---|---|
| DEQA (1) | 39 | 34 | — | — | — |
| DEQA (2) | — | — | 50 | — | — |
| DTDMAMS (3) | — | — | — | 58 | 62 |
| Co-Softener (4) | 54 | 40 | 27 | — | — |
| Glycosperse S-20 (5) | — | — | 15 | — | — |
| Glycerol Monostearate | — | — | — | — | |
| Color Care Agent (6) | 2 | 3 | 3 | 3 | 4 |
| Perfume | 2 | 2 | 2 | 1 | 2 |
| Perfume/Cyclodextrin Complex | — | 19 | — | — | 16 |
| Stearic Acid | — | — | — | 38 | 16 |
| Clay (7) | 3 | 2 | 3 | — | — |

(1) Di-(oleyloxyethyl) dimethyl ammonium methylsulfate
(2) Di-(soft-tallowyloxyethyl) hydroxyethyl methyl ammonium methylsulfate
(3) Ditallow dimethyl ammonium methylsulfate
(4) 1:2 Ratio of stearyldimethyl amine:triple-pressed stearic acid
(5) Polyethoxylated sorbitan monostearate, available from Lonza
(6) N,N,N',N'-tetrakis-(2-hydroxypropyl)ethylenediamine
(7) Calcium Bentonite Clay, Bentonite L, sold by Southern Clay Products Compositions A-E may be produced via the process as follows:

Preparation of Coating Mix

A batch of approximately 200 g is prepared as follows: Approximately 8 g of color care agent is combined with high shear mixing with 98 g of pre-melted softeners in a vessel immersed in a hot water bath to maintain the temperature between 70°–80° C. to form a coating mixture. In a separate container, a complex of cyclodextrin and perfume is created. A complex blend comprising 36% cyclodextrin/perfume complex and 64% softener compounds is separately prepared. The complex blend is is milled in a ball mil to reduce the particle size of the cyclodextrin/perfume complex. Approximately 90 g of the complex blend is added to the coating mixture with blending. Clay (8 g) is mixed in to achieve the desired viscosity. Approximately 3 g of free perfume is added to the formula and the mixture is blended until homogeneous.

Preparation of Fabric Conditioning Sheets

The coating mixture is applied to preweighed substrate sheets (approx. 1 g) of about 6.75 inches×12 inches (approximately 17 cm×30 cm) dimensions. The substrate sheets are comprised of about 4-denier spun bonded polyester. A small amount of the formula is placed on a heated metal plate with a spatula and then is spread evenly with a wire metal rod. A substrate sheet is placed on the metal plate to absorb the coating mixture. The sheet is then removed from the heated metal plate and allowed to cool to room temperature so that the coating mix can solidify. The sheet is weighed to determine the amount of coating mixture on the sheet. The target sheet weight is approximately 3.5 g. If the weight is in excess of the target weight, the sheet is placed back on the heated metal plate to remelt the coating mixture and remove some of the excess. If the weight is under the target weight, the sheet is also placed on the heated metal plate and more coating mixture is added.

EXAMPLE II

A dryer-activated color care article has the following composition:

| Component | A Wt. % | B Wt. % | C Wt. % | D Wt. % | E Wt. % |
|---|---|---|---|---|---|
| DEQA (1) | 20 | 22 | — | — | |
| DEQA (2) | — | — | 20 | — | — |
| DTDMAMS (3) | — | — | — | 17 | 19 |
| Co-Softener (4) | 13 | 12 | 13 | 15 | 12 |
| Glycosperse S-20 (5) | 10 | 10 | 12 | 9 | 10 |
| Sorbitan Tristearate | 10 | 9 | 9 | 8 | 9 |
| Color Care Agent (6) | 4 | 3 | 2 | 5 | 2 |
| Perfume | 2 | 2 | 3 | 2 | 1 |
| Cyclodextrin | 8 | 7 | 9 | 8 | 7 |
| Clay (7) | 2 | 2 | 3 | 4 | 3 |
| Substrate (8) | 29 | 30 | 26 | 31 | 35 |
| Water | 2 | 3 | 3 | 1 | 2 |

(1) Di-(oleyloxyethyl) dimethyl ammonium methylsulfate
(2) Di-(soft-tallowyloxyethyl) hydroxyethyl methyl ammonium methylsulfate
(3) Ditallow dimethyl ammonium methylsulfate
(4) 1:2 Ratio of stearyldimethyl amine:triple-pressed stearic acid
(5) Polyethoxylated sorbitan monostearate, available from Lonza
(6) N,N,N',N'-tetrakis-(2-hydroxypropyl)ethylenediamine
(7) Calcium Bentonite Clay, Bentonite L, sold by Southern Clay Products
(8) Non-woven polyester sheet

What is claimed is:

1. A dryer-activated laundry additive product comprising:

a substrate in the form of a sheet; and a color care composition disposed on said sheet, said composition comprising:

a) from about 0.1% to about 50% of by weight, of the composition N,N,N',N'-tetrakis-(2-hydroxypropyl) ethylenediamine;

b) from about 10% to about 50% by weight, of said composition of a fabric softening component.

2. A composition according to claim 1 wherein said color care composition further comprises an ingredient selected from the group consisting of cyclodextrins, perfumes, co-softeners, $C_{10}$–$C_{26}$ acyl sorbitan monoesters or diesters, clays and mixtures thereof.

3. A composition according to claim 2 wherein said composition has a thermal softening point of from about 35° C. to about 100° C.

4. A composition according to claim 1 wherein said fabric softener actives are selected from the group consisting of:

a) quaternary ammonium compounds having the formula:

$$[(R^1)_{4-p}—N^+—((CH_2)_v—Y—R^2)_p]X^-$$

wherein $R^1$ is $C_1$–$C_6$ alkyl, benzyl, and mixtures thereof; each $R^2$ is $C_8$–$C_{30}$ hydrocarbyl, substituted hydrocarbyl, and mixtures thereof; each Y is —O—(O)C—, —C(O)—O—, —NH—C(O)—, —C(O)—NH—, and mixtures thereof; X is a softener-compatible anion; p is from 1 to 3; each v is an integer from 1 to 4, and mixtures thereof;

b) quaternary ammonium fabric softening compounds or amine precursors thereof having the formula:

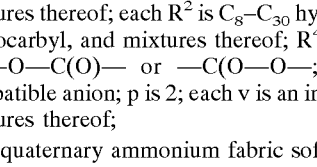

wherein $R^1$ is $C_1$–$C_4$ alkyl, $C_1$–$C_4$ hydroxy alkyl, and mixtures thereof; each $R^2$ is $C_8$–$C_{30}$ hydrocarbyl, substituted hydrocarbyl, and mixtures thereof; $R^4$ is $C_1$–$C_4$ alcohol; Q is —O—C(O)— or —C(O—O—; $X^-$ is a softener-compatible anion; p is 2; each v is an integer from 1 to 4, and mixtures thereof;

c) quaternary ammonium fabric softening compounds or amine precursors thereof having the formula:

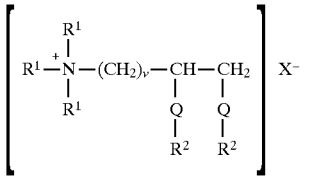

wherein $R^1$ is $C_1$–$C_4$ alkyl, $C_1$–$C_4$ hydroxy alkyl and mixtures thereof; each $R^2$ is $C_8$–$C_{30}$ hydrocarbyl, substituted hydrocarbyl, and mixtures thereof; Q is —O—C(O)— or —C(O)—O—; $X^-$ is a softener-compatible anion; each v is an integer from 1 to 4, and mixtures thereof; and d) mixtures thereof.

5. A composition according to claim 4 wherein said fabric softener active is selected from the group consisting of N,N-di(tallowyl-oxy-ethyl)N,N-dimethyl ammonium methyl sulfate; N,N-di(tallowyl-oxy-ethyl)-N-methyl, N-(2-hydroxyethyl) ammonium methyl sulfate; N,N-di(2-tallowyloxy-2-oxo-ethyl)-N,N-dimethyl ammonium methyl sulfate; N,N-di(2-tallowyloxyethylcarbonyloxyethyl)-N,N-dimethyl ammonium methyl sulfate; N-(2-tallowoyloxy-2-ethyl-N-(2-tallowyloxy-2-oxo-ethyl)-N,N-dimethyl ammonium methyl sulfate; N,N,N-tri(tallowyl-oxy-ethyl)-N-methyl ammonium methyl sulfate; N-(2-ditallowyloxy-2-oxoethyl)-N-(tallowyl)-N,N-dimethyl ammonium methyl sulfate; 1,2-ditallowyloxy-3-N,N,N-trimethylammoniopropane methyl sulfate; and mixtures thereof.

6. A composition according to claim 1 wherein said composition further comprises from about 1% to about 60% by weight, of a co-softener active, said co-softener active having the formula:

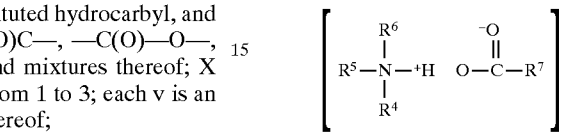

wherein $R^5$ is $C_8$–$C_{30}$ alkyl, $R^6$ and $R^4$ are each independently selected from the group consisting of $C_1$–$C_{30}$ alkyl; hydroxyalkyl having the Formula $R^8$ OH wherein $R^8$ is $C_2$–$C_{30}$ alkylene; alkyl ether having the formula $R^9O(C_nH_{2n}O)_m$ wherein $R^9$ is hydrogen, $C_1$–$C_{30}$ alkyl, $C_2$–$C_{30}$ alkenyl; n is 2 or 3, and m is from 1 to 30; $R^7$ is selected from the group consisting of $C_2$–$C_{30}$ unsubstituted alkyl, alkenyl, aryl, alkaryl, aralkyl, and mixtures thereof; $C_1$–$C_{30}$ substituted alkyl, alkenyl, aryl, alkaryl, aralkyl, and mixtures thereof, wherein said substituents are selected from the group consisting of halogen, carboxyl, hydroxyl, and mixtures thereof, provided said dryer-activated laundry composition has a thermal softening point of from about 35° C. to about 100° C.

7. A composition according to claim 6 wherein said nonionic fabric softener active comprises a $C_8$–$C_{30}$ alkyl fatty acid component and an amine component selected from the group consisting lauryldimethylamino, myristyldimethylamine, stearyldimethylamine, tallowdimethylamine, coconutdimethylamine, dilaurylmethylamine, distearylmethylamine, ditallowmethylamine, oleyldimethylatnine, dioleylmethylam ine, lauryldi(3-hydroxy-propyl)amine, stearyldi(2-hydroxyethyl)amine, trilaurylamine, laurylethylmethylamine, and mixtures thereof.

8. A composition according to claim 1 wherein said softener composition further comprises a nonionic fabric softener having an HLB of from about 2 to about 9.

9. A composition according to claim 8 wherein said nonionic fabric softener is selected from the group consisting of $C_{10}$–$C_{26}$ acyl sorbitan esters, polyglycerol monostearate, $C_8$–$C_{30}$ fatty acid partial esters of $C_2$–$C_8$ polyhydric alcohols, $C_8$–$C_{30}$ fatty acid partial esters of $C_2$–$C_8$ polyhydric anhydrides, and mixtures thereof.

* * * * *